US006130614A

United States Patent [19]

Miller et al.

[11] Patent Number: 6,130,614

[45] Date of Patent: Oct. 10, 2000

[54] TRUNK DETECTION AND RELEASE ASSEMBLY

[76] Inventors: Ronald H. Miller, 827 Berkshire Dr., Saline, Mich. 48176; Gary S. Strumolo, 18910 Hillcrest, Beverly Hills, Mich. 48025

[21] Appl. No.: 09/437,648

[22] Filed: Nov. 10, 1999

[51] Int. Cl.[7] ..... G08B 23/00

[52] U.S. Cl. ..... 340/573.4; 340/425.5; 340/573.1; 340/632; 73/23.2; 73/23.3

[58] Field of Search ..... 340/573.4, 573.1, 340/573, 632, 633, 634, 425.5, 426; 73/23.2, 23.3; 98/1.5

[56] References Cited

U.S. PATENT DOCUMENTS

| | | | |
|---|---|---|---|
| 3,992,909 | 11/1976 | McGhee . | |
| 4,742,761 | 5/1988 | Horstman | 98/1.5 |
| 5,132,663 | 7/1992 | Strohbl et al. . | |
| 5,404,128 | 4/1995 | Ogino et al. . | |
| 5,445,326 | 8/1995 | Ferro et al. . | |
| 5,598,141 | 1/1997 | Grasmann et al. | 340/426 |
| 5,682,145 | 10/1997 | Sweetman et al. | 340/632 |
| 5,793,291 | 8/1998 | Thornton | 340/573 |
| 5,859,479 | 1/1999 | David . | |
| 5,949,340 | 9/1999 | Rossi | 340/573.1 |
| 6,018,292 | 6/1999 | Penny, Jr. | 340/426 |

OTHER PUBLICATIONS

General Motors/Press Releases, wysiwyg://41/http://www.gm.com/about/info/news/events/trunk/pr2.htm, GM Announces Kits to Help Prevent Child Deaths in Trunks, Kits Help Prevent Entrapment and Provide Escape Release, Jun. 23, 1999.

General Motors/Press Releases, wysiwyg://41/http://www.gm.com/about/info/news/events/trunk/pr3.htm, National Safe Kids Campaign and General Motors Educate Public About Trunk Entrapment Hazards to Children, Jun. 23, 1999.

*Primary Examiner*—Jeffery A. Hofsass
*Assistant Examiner*—Phung Nguyen
*Attorney, Agent, or Firm*—Ford Global Technologies, Inc.

[57] ABSTRACT

A vehicle trunk detection and release system 10 which detects the presence of an individual within a trunk 14 and which releases the trunk 14, energizes the horn 16, and/or activates the headlights 17 upon such a detection. The system 10 further includes an illuminated touch pad 28 which opens the trunk 14 upon being touched.

16 Claims, 2 Drawing Sheets

TRUNK DETECTION AND RELEASE ASSEMBLY

FIELD OF THE INVENTION

This invention relates to a trunk detection and release assembly and more particularly, to a trunk detection and release assembly or system which detects the presence of an individual residing within the trunk of a vehicle and which opens and/or releases the trunk and/or which provides a warning signal notifying the user/owner of the vehicle of the presence of such an individual.

BACKGROUND OF THE INVENTION

Individuals, such as children, may become locked within a trunk of a vehicle. It may be desirable to detect the presence of such an individual and to automatically open or "release" the trunk, and/or to provide a warning signal to the user/operator of the vehicle which informs the user/operator of the detected presence of such an individual, in order to allow the user/operator to open the trunk. It may also be desirable to provide a mechanism and/or assembly, within the trunk, which allows a trapped individual to open the trunk.

Prior vehicle trunk detection and release systems addressed these needs by placing pressure sensors and/or heat sensors within the trunk in an attempt to sense or detect the presence of a trapped individual within the trunk. Particularly, the pressure sensors were typically placed on and/or within the "floor" of the trunk and detected the body weight of the trapped individual. Once the body weight of the individual was detected, the pressure sensors generated a warning signal to the user/operator of the vehicle notifying the user/operator of the detected presence of the trapped individual. The heat sensors were deployed throughout the trunk and detected the body heat of the trapped individual. The heat sensors similarly generated a warning signal upon detecting such body heat. While these sensors did indeed detect the presence of a trapped individual, they oftentimes provided a false warning or output signal due to the presence of relatively heavy objects (e.g. many grocery packages) within the trunk and/or due to the presence of hot food or other heated objects within the trunk and/or heat which was generated within the trunk during a hot summer day.

SUMMARY OF THE INVENTION

It is a first object of the present invention to provide a trunk detection and release system and/or apparatus which overcomes some or all of the previously delineated disadvantages of prior truck detection and release systems and/or assemblies and which detects the presence of an individual who is locked within a trunk.

It is a second object of the invention to provide a trunk detection and release system and/or assembly which overcomes some or all of the previously delineated disadvantages of prior systems and/or assemblies, which detects the presence of an individual within a vehicle trunk, and which automatically opens the trunk upon such a detection.

It is a third object of the present invention to provide a trunk detection and release system and/or assembly which overcomes some or all of the previously delineated disadvantages of prior systems and/or assemblies, which detects the presence of an individual within a vehicle trunk, and which provides a warning signal upon such a detection.

It is a fourth object of the present invention to provide a trunk detection and release system and/or assembly which overcomes some or all of the previously delineated disadvantages of prior systems and/or assemblies, and which includes a touch sensitive pad which opens or releases the trunk upon being touched by an individual who is residing within the trunk.

According to a first aspect of the present invention, a detection system for use with a vehicle of the type having a trunk which is selectively movable between an open and a closed position is provided. The detection system is adapted to detect the presence of a breathing individual who is residing within the trunk. The detection system includes a breathing detector which is disposed within said trunk, which is adapted to detect the breathing of the individual, and which generates a signal upon the detection of the breathing; and a controller assembly which is communicatively coupled to the breathing detector, which receives the signal, and which opens the trunk upon receipt of the signal.

A method for detecting the presence of an individual within a trunk of a vehicle is provided. The method includes the steps of measuring an amount of carbon dioxide within the trunk of the vehicle; and using the measured amount of carbon dioxide to determine the presence of an individual within the trunk of the vehicle.

These and other features, aspects, and advantages of the present invention will become apparent from a reading of the following specification and by reference to the following drawings.

DETAILED DESCRIPTION OF THE PREFERRED EMBODIMENT OF THE INVENTION

Figure 1:
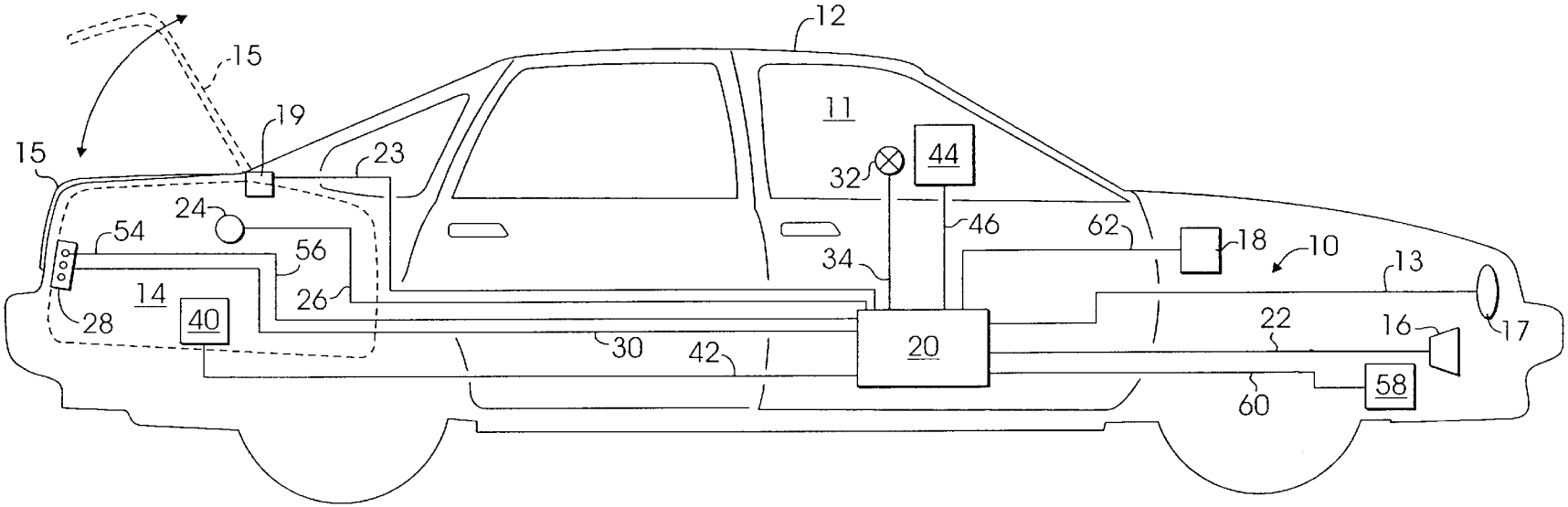
FIG. 1 is a block diagram of a vehicle which incorporates the trunk detection and release system which is made in accordance with the teachings of the preferred embodiment of the invention.

Referring now to FIG. 1, there is shown a vehicle trunk detection and release system 10 which is made in accordance with the teachings of the preferred embodiment of the invention and which is deployed within a vehicle 12 of the type which has a trunk 14. Vehicle 12 also has a member or a "trunk lid" 15 which is selectively movable between a first open or "released" position, which is shown in phantom in FIG. 1, in which trunk 14 is accessible or opened, and a second closed position, which is also shown in FIG. 1, in which trunk 14 is closed and made to be substantially inaccessible. Vehicle 12 also includes a selectively energizable horn 16, headlights 17, and an ignition switch 18 which is selectively movable to a certain position which allows and/or causes the vehicle 12 to be driven. Vehicle 12 may also include a trunk release switch or device 19 which, when activated, causes the trunk lid 15 to move or occupy the "open" or "release" position.

System 10 includes a controller assembly 20 which operates under stored program control and which is communicatively and physically coupled to the horn 16 by bus 22, to the trunk release switch 19 by use of bus 23, and to the headlights 17 by bus 13. In one non-limiting embodiment of the invention, controller assembly 20 comprises a microprocessor or micro-controller.

System 10 further includes at least one bodily-function sensor 24 (e.g. such as and without limitation a sensor which is adapted to detect an individual's breath) which is resident within trunk 14 and which is coupled to controller assembly 20 by use of bus 26. System 10 also includes an illuminated touch-sensitive and/or capacitance detection pad or member 28 which is coupled to the controller assembly 20 by use of bus 30. The at least one sensor 24 may be mounted within the trunk lid 15 or within another convenient location within the trunk 14. Similarly, the illuminated touch-pad may similarly be mounted in any convenient location within the trunk 14. System 10 further includes a selectively depressible switch 32 which is coupled to the controller assembly 20 by use of bus 34 and which may be placed within the passenger compartment 11. In a non-limiting alternate embodiment of the invention, system 10 includes a conventional camera 40 (e.g. a commercially available "CCD" and/or "night vision" type camera) which is resident within the trunk 14 and which is coupled to the controller assembly 20 by use of the bus 42. Controller assembly 20 may be further physically and communicatively coupled to a display apparatus 44 (e.g. a "heads up" type display) which may be present in the passenger compartment 11 of the vehicle 12, by use of bus 46.

In operation, system 10 is adapted to detect the presence of an individual who may be locked and/or resident within trunk 14 in several independently usable ways or manners, and may, in non-limiting embodiments, allow the closed trunk 14 to be opened by the individual. Particularly, the at least one sensor 24 senses or detects the presence or occurrence of a certain bodily function of an individual residing within the closed trunk 14. In one non-limiting embodiment, this sensed bodily function is that of breathing and, in this embodiment, the at least one sensor 24 comprises a carbon-dioxide sensor, effective to sense the presence or level within trunk 14, of the carbon-dioxide "by-product" which is generated by the breathing of that individual.

Particularly, if the sensed level of carbon dioxide is above a programmable and certain stored level or value, which may storably reside within controller assembly 20 or within the at least one sensor 24, the at least one bodily function sensor 24 generates and communicates a warning signal to the controller assembly 20 by use of bus 26. Alternatively, the actual sensed carbon dioxide level, existing within trunk 14, is communicated to the controller 20 by the at least one sensor 24 and the controller assembly 20 determines whether the sensed level is above the stored predetermined threshold. If the level is above the predetermined threshold level, the controller assembly 20 performs the functions and/or the operations which are delineated below.

Upon receipt of the generated warning signal or upon a determination, by controller assembly 20, that the sensed carbon dioxide level is above the predetermined threshold level, controller assembly 20, by use of bus 23, activates the trunk release switch 19, effective to open the trunk lid 15. The use of such a bodily function sensor 24 substantially overcomes the "false alarms" of prior sensors, since the at least one sensor 24 will not provide an alarm signal in response to the placement of hot foods or heated materials being placed within the trunk 14, in response to the placement of vehicle 12 for a prolonged period of time in a parking lot on a hot summer day, or in response to relatively heavy loads or materials being placed within the trunk 14. System 10 also therefore allows for the trunk 14 to be "automatically opened" without intervention by the user/operator of the vehicle 12. Moreover, after receiving the warning signal or after determining that the sensed carbon dioxide level is above a predetermined threshold value, controller assembly 20 may alternatively or concurrently energize the horn 16, by generating and placing a signal on bus 22, thereby providing a user/operator of the vehicle with an audible indication that someone is within the trunk 14. In this manner the user/operator may manually open the trunk lid 15. A warning light, resident within the passenger compartment 11 of the vehicle 12, may similarly be energized by controller assembly 20. Additionally, headlights 17, by use of bus 13, may also be selectively energized by controller assembly 20 in response to a receipt of a warning signal from sensor 24 and/or in response to a determination that the sensed carbon dioxide level is above the predetermined threshold level value.

Further, in an alternate embodiment of the invention, system 10 includes the illuminated touch sensitive pad 28 which senses the capacitance of the human body and which, when touched, generates and communicates a signal to the controller assembly 20, by use of bus 30, which causes the controller assembly to open the deck lid 15 in the manner which has been previously delineated and/or which causes the horn 16 (or visual indicator) to be energized in the manner which has been previously delineated. In this manner, the individual may "free themselves" from the confines of the trunk 14.

Figure 2:
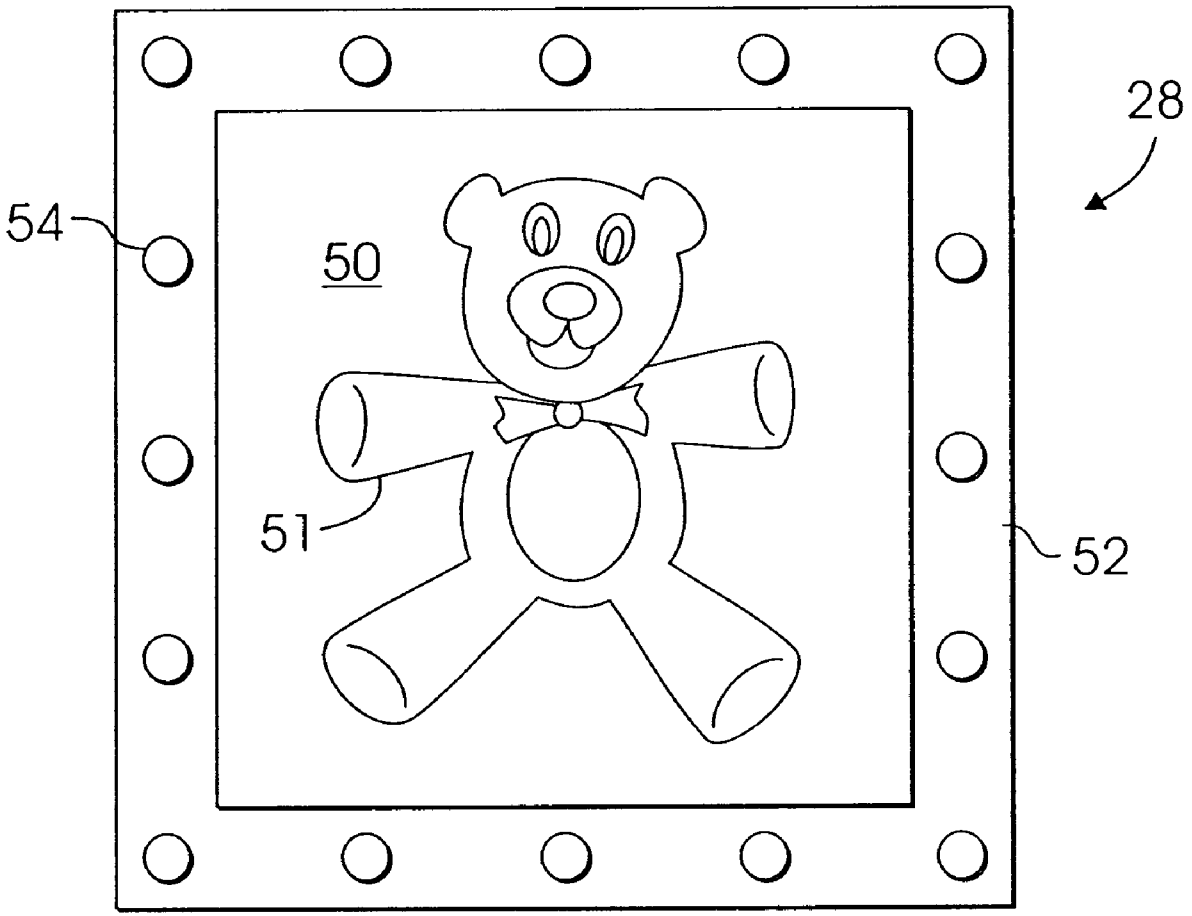
FIG. 2 is a top view of the illuminated touch sensitive pad which is utilized within and which forms a part of the trunk detection and release system which is made in accordance with the teachings of the preferred embodiment of the invention and which is shown in FIG. 1.

As best shown in FIG. 2, the touch pad 28 includes a first capacitance detection portion 50 (e.g., such as that used upon a commercially available "notebook" type computer) which is fixedly secured, attached, and/or mounted upon a second member 52 having a plurality of light emitting diodes or other types of light emitting members 54. These members 54 are physically and communicatively coupled to the controller assembly 20 by the use of bus 56 and, in one non-limiting embodiment of the invention, receive electric power from the controller assembly 20, effective to allow and/or to cause the members 54 to be illuminated. Such electric power is placed onto bus 56 by the controller assembly 20 and may be "sourced" or obtained from the vehicle battery 58 which is coupled to the controller assembly by bus 60.

The light emitting members 54 cooperatively make the member or pad 50 "interesting" to a trapped child and induce the child to touch the member or pad 50. The light emitting members 54 also allow the pad 50 to be seen within the dark confines of the closed trunk 14 and allow trapped individuals to recognize and utilize the member or pad 50. Additionally, the member or pad 50 obviates the need for a complicated motion or procedure to open the trunk lid 15 which is unknown and perhaps undecipherable to a child or an older adult. In another non-limiting embodiment, an image 51 may be placed and/or imprinted upon the member or pad 50, in order to "grab the attention" of a child. Alternatively, image 51 may be placed upon a transparency which may selectively overlay the member or pad 50.

In another alternate embodiment of the invention, camera 40 provides the user/operator of the vehicle 12 with pictures of the "inside" or interior of the trunk 14, by use of display 44, thereby allowing the user/operator to actually "see what is inside" the trunk 14, in order to ensure that no individual is currently residing within the trunk 14. It should be appreciated that camera 40, illuminated touch pad 28, and the at least one bodily function sensor 24 may be used singularly within a system 10 or may be operatively combined in any desired manner.

In yet another alternated embodiment of the invention, sensor 24 may comprise a voice sensor which is adapted to detect the presence of a human voice and to generate and communicate a warning signal to the controller assembly 20, by use of bus 23, in the event that such a human voice is detected. The controller assembly 20, upon receipt of the warning signal, may energize the horn 16 (or other visual indicator) or open the trunk lid 15 in the manner which has been previously delineated.

In another alternate embodiment of the invention, switch 32, when depressed, causes a signal to be generated and communicated to the controller assembly 20 by use of bus 34 which causes the system 10 to be inoperable (e.g. controller assembly 20 will ignore all of the warning and/or carbon dioxide detection and/or "level determination" type signals which may be communicated to it). A second depression of switch 32 will allow system 10 to resume operation. In this manner, a user/operator of the vehicle 12 may deactivate the system 10 in the event of a malfunction of the system 10 or in the event of a malfunction of any portion of the vehicle 12.

In yet another non-limiting embodiment, controller assembly 20 may be operable only if the vehicle 12 is stationary in order to substantially prevent the trunk lid 15 from being released or opened as the vehicle 12 is being driven and/or to prevent the energization of the horn 16 as the vehicle 12 is being driven. In this embodiment, once controller assembly 23, by use of bus 62, determines that the ignition switch 18 is in a "run" or "vehicle driven" position, controller assembly 20 will ignore all warning signals and/or "level determination" type signals until the ignition switch 18 is placed in the "off" position. Moreover, controller assembly 20 may include a timer which causes the system 10 (e.g. controller assembly 20) to be inoperable after a certain duration of time has passed since the controller assembly 20 began operation.

It should be understood that the invention is not limited to the exact construction and/or method which has been illustrated and described above, but that various changes may be made without departing from the spirit and the scope of the invention.

What is claimed is:

1. A detection system for use within a vehicle of the type having a trunk which is selectively movable between an open and a closed position, said detection system being adapted to detect the presence of a breathing individual within said trunk, said detection system comprising:

a breathing detector which is disposed within said trunk, which is adapted to detect the breathing of said individual, and which generates a signal upon the detection of said breathing; and a controller assembly which is communicatively coupled to said breathing detector, which receives said signal, and which opens said trunk upon receipt of said signal.

2. The detection system of claim 1 wherein carbon dioxide is emitted by said individual as said individual breathes and wherein said breathing detector detects the presence of said carbon dioxide within said trunk.

3. The detection system of claim 1 wherein said vehicle is of the further type which includes an ignition switch which may be selectively moved to a certain position and wherein said controller assembly is coupled to said ignition switch, senses said placement of said ignition switch in said certain position, and causes said trunk to be opened in response to said signal from said breathing detector only if said ignition switch is placed in said certain position.

4. The detection system of claim 1 wherein said vehicle is of the type which is selectively driven and wherein said controller assembly prevents said trunk from being open when said vehicle is driven.

5. The detection system of claim 1 further including an illuminated touch sensitive pad which is disposed within said trunk, which is coupled to said controller assembly, and which selectively communicates a second signal to said controller assembly upon being touched.

6. The detection system of claim 5 wherein said controller assembly, upon receipt of said second signal, opens said trunk.

7. The detection system of claim 2 wherein said breathing detector measures the amount of carbon dioxide which is resident within said trunk, stores a certain value, compares said measured amount of carbon dioxide to said certain value, and generates said signal only if said measured amount of said carbon dioxide is greater than said certain value.

8. The detection system of claim 1 wherein said controller assembly further includes a timer which allows said detection system to be operable for a certain period of time.

9. The detection system of claim 5 wherein said touch sensitive pad comprises an illuminated capacitance sensing pad.

10. The detection system of claim 1 wherein said individual comprises a child.

11. The detection system of claim 1 further comprising a camera which is mounted within said trunk and which is coupled to said controller assembly.

12. A method for detecting the presence of a child within a trunk of a vehicle, said method comprising the steps of:

measuring an amount of carbon-dioxide within said trunk of said vehicle; and using said measured amount of carbon dioxide to determine the presence of said child within said trunk of said vehicle.

13. The method of claim 12 further comprising the steps of:

providing a voice detection module within said trunk; and using said voice detection module to sense the presence of said child within said trunk.

14. The method of claim 13 further comprising the step of detecting said presence of said child only when said vehicle is stationary.

15. An assembly for detecting the presence of an individual within a trunk of a vehicle, said assembly comprising:

a sensor which is mounted within said trunk and that detects the occurrence of at least one bodily function of said individual; and a controller assembly which is communicatively coupled to said sensor and which provides a signal when said sensor detects the occurrence of at least one bodily function of said individual, wherein said at least one bodily function comprises breathing.

16. The assembly of claim 15 wherein said sensor comprises a carbon dioxide sensor.

* * * * *

US006130614C1

(12) EX PARTE REEXAMINATION CERTIFICATE (5715th)

United States Patent
Miller et al.

(10) Number: US 6,130,614 C1
(45) Certificate Issued: Mar. 20, 2007

(54) TRUNK DETECTION AND RELEASE ASSEMBLY

(75) Inventors: Ronald H. Miller, Saline, MI (US); Gary S. Strumolo, Beverly Hills, MI (US)

(73) Assignee: Ford Motor Company, Dearborn, MI (US)

Reexamination Request:
No. 90/006,690, Jul. 1, 2003

Reexamination Certificate for:

| | |
|---|---|
| Patent No.: | **6,130,614** |
| Issued: | **Oct. 10, 2000** |
| Appl. No.: | **09/437,648** |
| Filed: | **Nov. 10, 1999** |

(51) Int. Cl.

| | |
|---|---|
| ***E05B 65/19*** | (2006.01) |
| ***E05B 65/12*** | (2006.01) |
| ***G08B 23/00*** | (2006.01) |

(52) U.S. Cl. ..... 340/573.4; 340/425.5; 340/573.1; 340/632; 73/23.2; 73/23.3

(58) Field of Classification Search ..... 340/562, 340/530, 573.1, 573.4, 632, 633, 634, 425.5, 340/426; 73/23.2, 23.3; 98/1.5

See application file for complete search history.

(56) References Cited

U.S. PATENT DOCUMENTS

| | | | | |
|---|---|---|---|---|
| 5,464,369 A | | 11/1995 | Federspiel | 454/256 |
| 5,856,646 A | * | 1/1999 | Simon | 200/600 |
| 6,150,927 A | | 11/2000 | Nesbitt | 340/426 |
| 6,222,442 B1 | | 4/2001 | Gager et al. | 340/426 |
| 6,349,984 B1 | * | 2/2002 | Marrazzo et al. | 292/336.3 |

FOREIGN PATENT DOCUMENTS

| | | |
|---|---|---|
| EP | 1 039 077 A2 | 9/2000 |
| EP | 1 039 077 A3 | 9/2000 |
| WO | WO 99/04119 | 1/1999 |

* cited by examiner

*Primary Examiner*—Toan N. Pham

(57) ABSTRACT

A vehicle trunk detection and release system 10 which detects the presence of an individual within a trunk 14 and which releases the trunk 14, energizes the horn 16, and/or activates the headlights 17 upon such a detection. The system 10 further includes an illuminated touch pad 28 which opens the trunk 14 upon being touched.

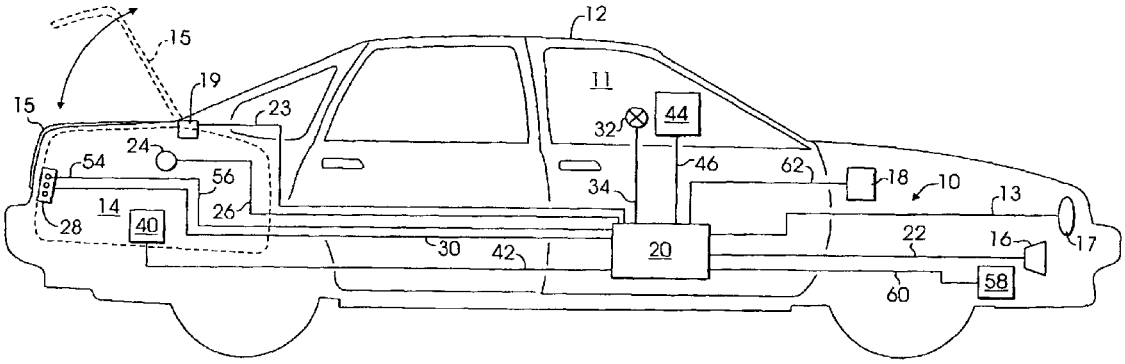

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *